US005167715A

United States Patent [19]

Kalafala et al.

[11] Patent Number: 5,167,715

[45] Date of Patent: Dec. 1, 1992

[54] APPARATUS AND METHOD FOR IMPREGNATING SUPERCONDUCTOR WINDINGS

[75] Inventors: Ahmed K. Kalafala, Albany; Karl F. Schoch, Scotia; Dan A. Gross; Evangelos T. Laskaris, both of Schenectady, all of N.Y.

[73] Assignee: General Electric Company, Schenectady, N.Y.

[21] Appl. No.: 664,155

[22] Filed: Mar. 4, 1991

[51] Int. Cl.[5] ..... B05C 3/02; B05C 11/11

[52] U.S. Cl. ..... 118/712; 29/820; 118/50.1; 118/429; 118/DIG. 22; 427/116

[58] Field of Search ..... 118/50, 50.1, 693, DIG. 19, 118/DIG. 22; 427/62, 116, 294; 501/1, 730, 739, 826, 924; 29/599, 606, 609, 820

[56] References Cited

U.S. PATENT DOCUMENTS

| | | | |
|---|---|---|---|
| 1,512,095 | 10/1924 | Hopkinson et al. | 118/DIG. 19 |
| 1,587,110 | 6/1926 | Fisher | 118/DIG. 19 |
| 2,009,820 | 7/1935 | Shanklin | 118/50 |
| 2,605,738 | 8/1952 | Grieve | 118/50 |
| 4,338,353 | 7/1982 | Melchior | 427/294 |

*Primary Examiner*—Michael G. Wityshyn

*Attorney, Agent, or Firm*—James R. McDaniel; Paul R. Webb, II

[57] ABSTRACT

A method and apparatus for impregnating the superconductors on a superconductor winding with epoxy such that a vacuum/pressure containment vessel, in which the winding is placed, allows epoxy to be introduced into the vessel whereby the epoxy eventually impregnates the superconductors through the application of various evacuating, pressuring and epoxy transporting steps.

8 Claims, 5 Drawing Sheets

OVERFLOW PAN
V
V
V
22
2
3
4
5
6
7
8
9
10
11
12
13
14
15
16
17
18
19
20
21
23
24
26
28
29
30
32
34
36
38
40
41
42
44
45
46
48
60

22
MIXER
OVEN
34
32
24
8
29
28
30
V
26

APPARATUS AND METHOD FOR IMPREGNATING SUPERCONDUCTOR WINDINGS

BACKGROUND OF THE INVENTION

This invention relates to superconductor winding impregnation systems of the type that have impregnation assemblies that employ a pressure/vacuum containment vessel in order to form a more uniform and complete impregnation of the windings. The preferred material for impregnation is conventional epoxy. Systems of this type generally allow all of the available surface area of the windings to be impregnated while substantially reducing the likelihood an excessive amount of epoxy being retained which must be removed. The excess epoxy is usually removed in a manual fashion. Also, the present invention substantially reduces the likelihood of undesirable trapped gas bubbles forming during the impregnation. A superconductive winding is placed such that the winding is subjected, at various times, to vacuum and pressure and an epoxy compound is allowed to flow and, later, cure around the winding to impregnate the winding. This invention relates to certain unique containment vessel assemblies and the vacuum/pressure and epoxy handling/curing means, in association, therewith.

It is known, in superconductive winding impregnation systems, to make use of a system which includes an impregnation vessel large enough to adequately contain enough epoxy compound such that the winding can be completely submersed in the epoxy compound and the epoxy allowed to cure. In each of these cases, the size of the windings was the prohibitive factor in the impregnation of the windings because the containment vessel has to be large enough, typically 5-6' high and 2.5-3' in diameter for larger sized windings, in order to accommodate the winding. Due to the large volume of the vessel, a large amount of epoxy had to be used to insure that the winding was sufficiently covered and impregnated by the epoxy. Also, if the windings are varied in size and shape, there was a fair amount of guesswork involved in determining the amount of epoxy needed that would be adequate enough to impregnate the winding. Furthermore, because the winding was required to remain in the containment vessel so that the epoxy would adequately cure and impregnate the winding, the excess epoxy which remained on the winding, had to be manually removed, typically, by chipping. The process of chipping could possibly damage the windings. A more advantageous system, then, would be presented if such amounts of epoxy and manual removal of the epoxy were reduced.

It is also known that, when the epoxy was mixed and poured into the containment vessel or when the winding was placed in the epoxy batch, voids could form in the epoxy due to trapped residual gas. These voids, if not completely eliminated, would adversely affect the impregnation of the winding. Such a void could possibly result in a mechanical failure of the cured epoxy and may, ultimately, initiate a loss of superconductivity in the winding. Therefore, reductions in the amount of voids present in the impregnation system would also be advantageous.

It is apparent from the above that there exists a need in the art for a superconductive winding impregnation system which is efficient through simplicity of parts and uniqueness of structure, and which, at least, equals the safety characteristics of the known impregnation systems, but which at the same time substantially reduces the amount of epoxy used to adequately impregnate the windings and the likelihood of undesirable gas bubbles being trapped in the epoxy. It is a purpose of this invention to fulfill this and other needs in the art in a manner more apparent to the skilled artisan once given the following disclosure.

SUMMARY OF THE INVENTION

Generally speaking, this invention fulfills these needs by providing an apparatus for impregnating superconductor windings with an epoxy compound, comprising a pressure/vacuum containment vessel, a superconductor winding with a bobbin with first and second sides having superconductors such that said winding is located substantially within said vessel, a pressure/vacuum means, a heating means, an epoxy compound for impregnating said windings, and a means to introduce said epoxy compound into said vessel such that said windings are impregnated with said epoxy.

In certain preferred embodiments, the pressure/vacuum containment vessel is of such a size and shape so as to be able to accommodate a variety of superconductor winding sizes. Also, the epoxy introduction means is made up of an epoxy pump, epoxy piping and conduits, epoxy level detectors, epoxy heaters and safety alarms.

In another further preferred embodiment, substantially all of the voids created by trapped gases located within the impregnation system, after the winding is placed within the confines of the vessel, are removed.

In particularly preferred embodiments, the impregnation system of this invention consists essentially of a pressure/vacuum containment vessel; a superconductor winding located substantially within the vessel; an epoxy compound for impregnating the windings; an epoxy introduction means; an epoxy detection means; and an epoxy curing means. In this way, not only are a variety of sizes of windings accommodated by the vessel, but the unique structure substantially reduces the amount of epoxy used and the likelihood of residual gas bubbles being trapped in the system.

The preferred superconductor windings impregnation system, according to this invention, offers the following advantages: easy assembly and repair; good durability; excellent economy; good safety characteristics; and good impregnation results. In fact, in many of the preferred embodiments, these factors of economy and impregnation are optimized to an extent considerably higher than, heretofore, achieved in prior, known impregnation systems.

DETAILED DESCRIPTION OF THE INVENTION

Figure 1:
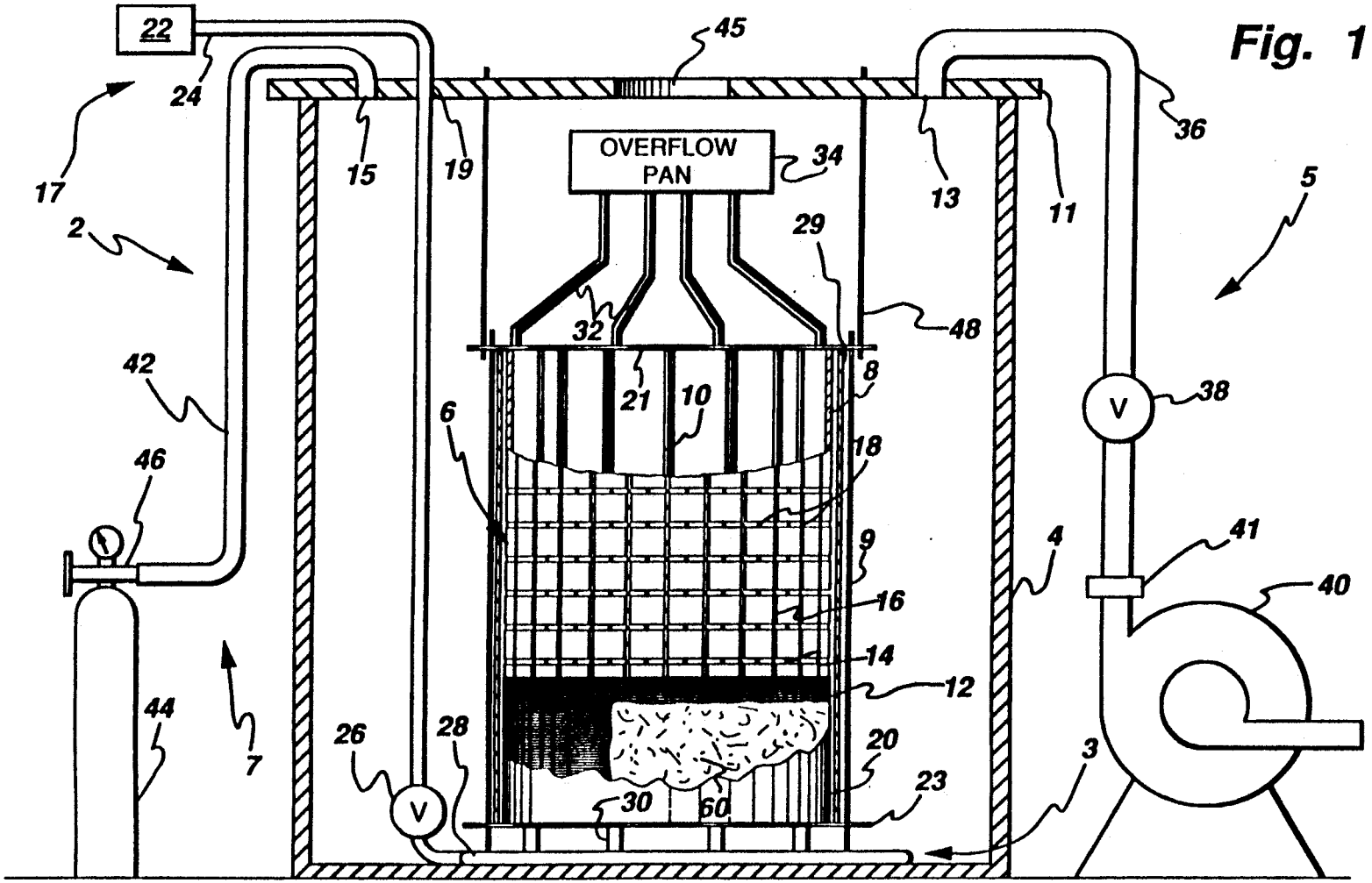
FIG. 1 is a schematic drawing of an impregnating device for superconductive windings, according to the present invention.

With reference first to FIG. 1, there is illustrated a superconductive winding impregnation system 2 which is comprised of four general sub-systems: containment sub-system 3; vacuum sub-system 5; pressure sub-system 7; and epoxy transport sub-system 17.

Containment sub-system 3 includes a containment vessel 4 preferably constructed of a mild steel, and a lid 11, preferably, constructed of aluminum having portals 13, 15, 19 such that vessel 4 is capable of being evacuated by vacuum sub-system 5, pressurized by pressure sub-system 7 and filled by epoxy transport sub-system 17.

Figure 5:
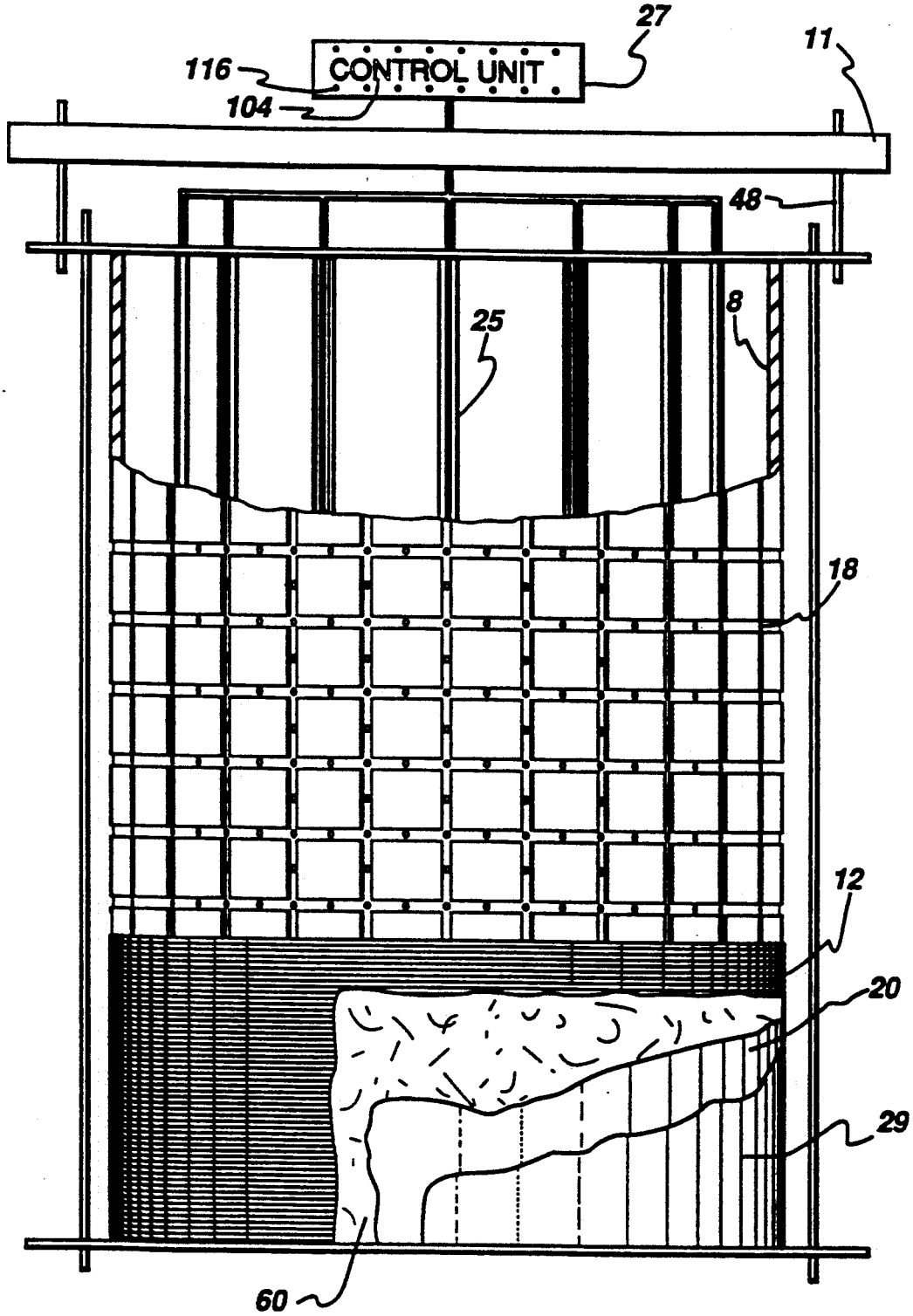
FIG. 5 is a side plan view of the epoxy impregnation detection system, according to the present invention.

Located within vessel 4 is a conventional superconductor winding 6 and epoxy holding copper sheet 29. Winding 6, preferably, is enclosed by sheet 29. Superconductor winding 6 and sheet 29 are supported within vessel 4 by conventional, metallic support rods 9 and 48 and end rings 21, 23. Superconductor winding 6 is constructed of bobbin 8, superconductors 12, horizontal channels 14, vertical channels 16, epoxy level sensors 18 and conventional winding alarms 25 (FIG. 5). Sensors 18 are rigidly secured to channels 14, 16 and become an integral part of the impregnated assembly when the epoxy cures. Sensors 18 should not adversely affect the mechanical properties of the cured epoxy. Also, well-known, radiant, infrared heaters 10 for curing the epoxy 20 are positioned inside core 8 and contained within vessel 4.

Figure 2B:
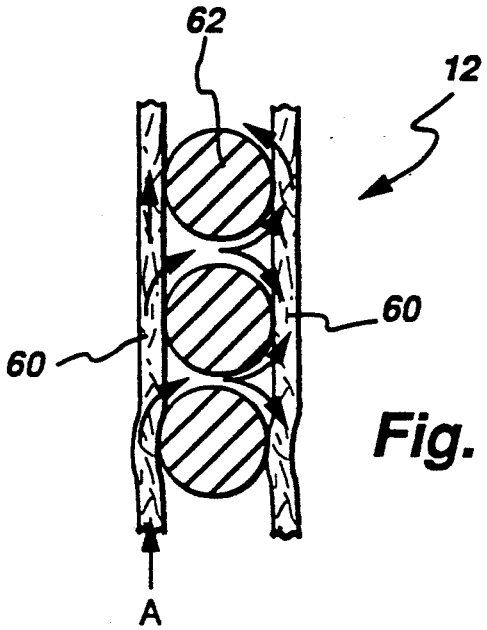
FIG. 2*b* is a cross-sectional view of the superconductive windings wrapped with glass cloth and being impregnated with the epoxy.
Figure 2A:
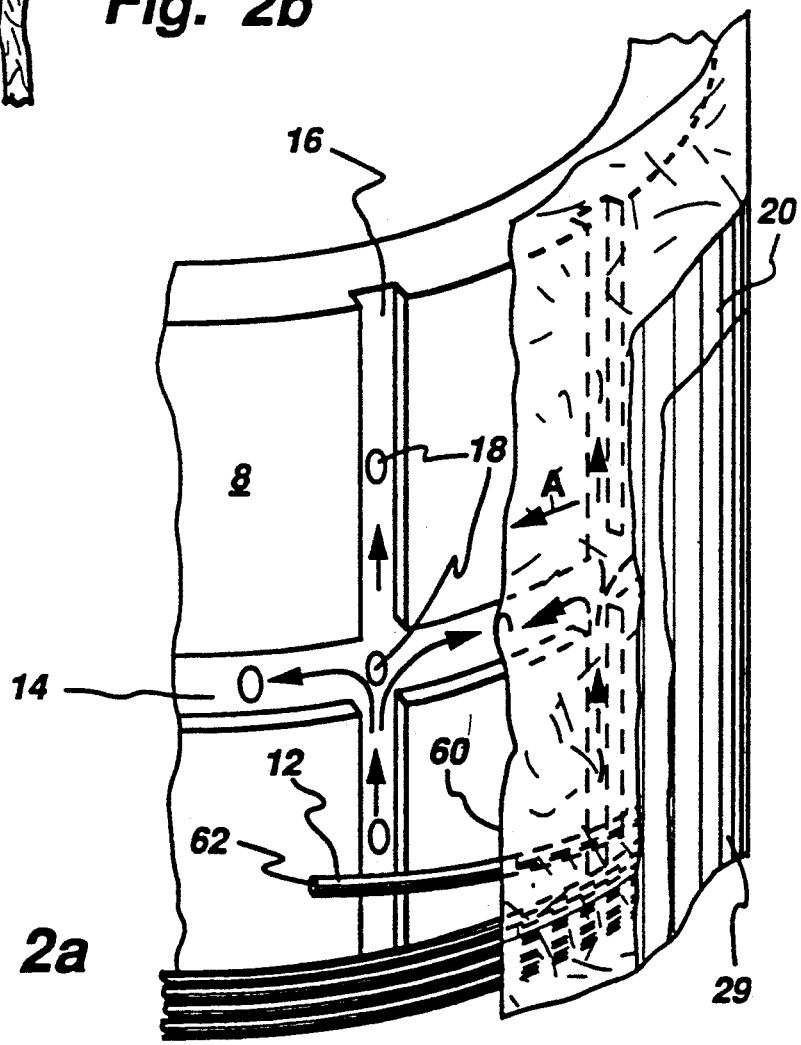
FIG. 2*a* is a detailed drawing of the coil form with the superconductive windings, according to the present invention.

Regarding the specifics of superconductor winding 6, bobbin 8 contains channels 14 and 16 (FIG. 2*a*). Channels 14 and 16 are machined into core 8 by conventional machining techniques and are approximately 1/16" (deep)×1/16" (wide) and run the circumference and length, respectively, of bobbin 8. It is to be understood that channels 14 and 16 can be of a variety of shapes and depths as long as epoxy is allowed to flow along these channels. The flow of epoxy along channels 14, 16 will be discussed later.

Superconductor 12, preferably, is constructed of niobium-tin ($Nb_3Sn$), superconductor wires 62 (FIG. 2*b*) and conventional glass cloth 60, preferably 5–10 mils thick, with glass cloth 60 being placed between successive layers of wires 60 (FIG. 2*a*). Glass cloth 60, preferably, is one sheet which is placed over a layer of superconductor 12 in the direction of arrow A (FIG. 2*a*). Glass cloth 60 should reinforce the mechanical properties of the cured epoxy 20 and should induce epoxy 20 to spread throughout windings 6 via a capillary flow created by the spaces (not shown) contained in glass cloth 60. Windings 12 are wound around bobbin 8 such that windings 12 substantially enclose entire circumferential areas of bobbin 8 as dictated by the intended use of the windings. This technique of layering wires 62 and glass cloth 60 around bobbin 8 is a well-known technique, commonly referred to as multiple layer superconductive winding technique.

Winding 6 is substantially enclosed by epoxy holding sheet 29. Sheet 29, preferably is constructed of copper. Sheet 29 should be of such size and shape that when epoxy 20 is introduced into sheet 29, epoxy 20 should entirely cover bobbin 8 and impregnate superconductors 12 while leaving an amount of epoxy 20 that projects a small distance beyond the inner diametrical surface of bobbin 8 and the outer layer of superconductors 12. Preferably, sheet 29 is wrapped around winding 6 in a cylindrical fashion to substantially cover winding 6 (FIG. 2*a*). End rings 21, 23 are rigidly attached by conventional techniques to the top and bottom of sheet 29 and winding 6 to substantially provide a leak-proof enclosure for superconductors 12.

Referring again to FIG. 1, vacuum sub-system 5 which is located adjacent containment sub-system 3, includes a conventional vacuum pipe 36 connected by well-known connectors at one end to a conventional vacuum valve 38 and at the other end to portal 13 in lid 11 or in vessel 4. Valve 38 is connected by conventional connectors to a conventional vacuum pump 40 via a conventional liquid gas trap 41. Vacuum pump 40 must be of a type such that it will substantially evacuate vessel 4 when superconductor 6 is located with vessel 4.

Located adjacent containment sub-system 3 is pressure sub-system 7. In particular, pressure sub-system 7 has a conventional pressure pipe 42 which is connected by conventional connectors at one end to pressure regulator 46 and at the other end to portal 15 in lid 11. A gas source 44, preferably, carbon dioxide ($CO_2$) or nitrogen ($N_2$) is connected to regulator 46. Gas source 44 and regulator 46 must be of a type which can deliver a predetermined pressure to containment vessel 4, the pressure preferably being between 10 and 600 mmHg.

Epoxy transport sub-system 17 is located substantially within vessel 4, except for epoxy mixer oven 22. Transport sub-system 17 includes a well-known epoxy mixer oven 22, portal 19 in lid 11, epoxy tubing 24, a conventional, pressure-actuated back-flow inhibitor valve 26, epoxy conduits 28, epoxy entry pipes 30, overflow pipes 32 and overflow pan 34. Tubing 24, conduits 28 and pipes 30 are, preferably, constructed of copper. Epoxy mixer oven 22 is of a type such that the epoxy is introduced at the bottom of superconductor 6 at approximately 50° C.

Epoxy overflow pipes 32 are connected by conventional connectors to channels 16. These pipes 32 allow any excess epoxy which has traversed the axial length of winding 6 to be transported to conventional, overflow pan 34. Again, the details of the epoxy flow along channel 16 will be discussed later.

In operation, after bobbin 8 is substantially wrapped by superconductor 12, to form winding 6, sheet 29 is wrapped around winding 6 and end caps 21,23 are attached. Support rods 9 are rigidly attached by conventional securing devices (not shown) to the end caps 21,23 to provide support for winding 6, sheet 29 and end caps 21,23. Also, support rods 48 are rigidly attached by conventional securing devices (not shown) between end cap 21 and lid 11.

After rods 48 are attached, sheet 29 and winding 6, having heaters 10 rigidly attached inside of winding 6 by conventional fasteners (not shown), is placed within containment vessel 4. Winding 6 is then placed within vessel 4, lid 11 is rigidly attached by conventional fasteners (not shown) to the top of vessel 4. After winding 6 is placed within vessel 4 and lid 11 is secured to vessel 4, winding 6 will be ready to be impregnated by the epoxy 20.

Once winding 6 is sealed within vessel 4, vessel 4 is evacuated by vacuum sub-system 5 to a pressure of approximately 1–2 mmHg and winding 6 is heated by heater 10. The temperature of this initial heating should be approximately 100° C. or whatever temperature is appropriate for drying off substantially all of the moisture contained within vessel 4 and on winding 6, sheet 29 and end caps 21,23.

When the initial evacuating and heating step is completed, gas, preferably carbon dioxide ($CO_2$) is introduced, preferably, at a pressure of 14 mmHg. The $CO_2$ is used for several reasons. First, the $CO_2$ dissolves in the epoxy, so if a bubble of $CO_2$ is trapped in the epoxy while the vessel 4 is being filled with epoxy and creates a void in the epoxy, the bubble should disappear as the $CO_2$ dissolves in the epoxy. Secondly, vessel 4 is pressurized by the $CO_2$ so that the volatile constituents of the epoxy mixture will not get sucked out back into either vacuum sub-system 5 or pressure sub-system 7 and adversely affect the mechanical properties of the cured epoxy.

Once vessel 4 is pressurized preferably to 14 mmHg, by pressure sub-system 7 and the windings have cooled to 80° C., vessel 4 is ready for introduction of epoxy 20 (FIGS. 1 and 5). Epoxy 20 is a well-known low viscosity epoxy, preferably comprised of a resin, a curing agent, a reactive diluent and an accelerator. The resin is, preferably, a diglycidyl ether of Bisphenol A (DGEBA). The curing agent is, preferably, 80 phr nadic methyl anhydride. The reactive diluent is a difunctional, low viscosity diluent, preferably, diglycidyl ether of 1,4-butanediol. The accelerator is a latent accelerator, preferably dimethyloctylamine boron trichloride.

Figure 3:
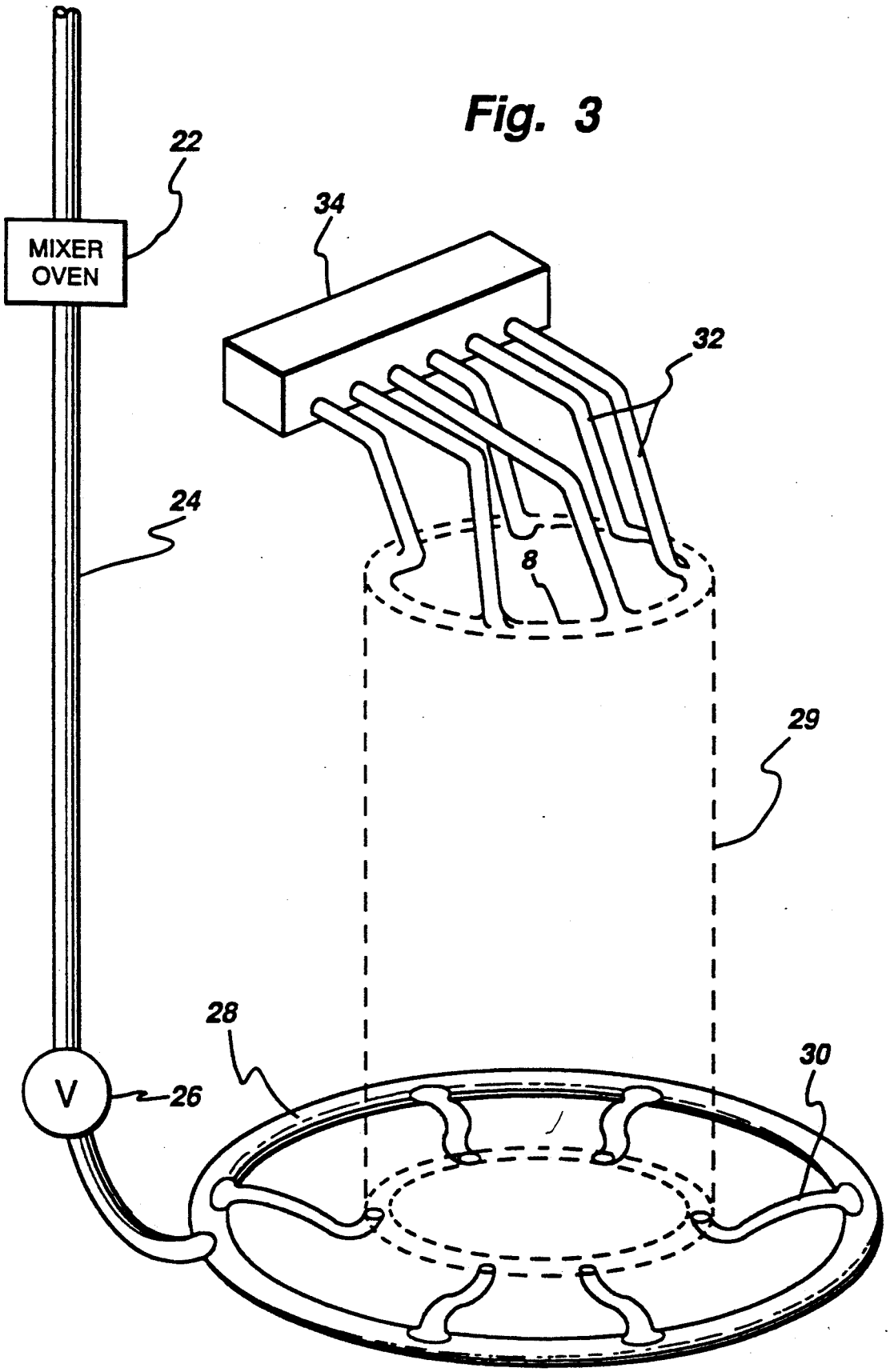
FIG. 3 is a schematic drawing of the epoxy transportation system.

With reference to FIGS. 1, 2*a* and 3, epoxy 20 is prepared by well-known epoxy preparation techniques in oven 22 and is piped, preferably at a temperature of 50°-60° C., past valve 26, through conduits 28 and pipes 30 through end cap 23 to the bottom of winding 6. Pipes 30 are connected by conventional fluid connectors (not shown) to the bottom end of end cap 23. The area between sheet 29 and winding 6, namely, the area around superconductors 12 is connected by conventional fluid connector (not shown) to end cap 23.

After epoxy has begun to fill up to the bottom ends of sheet 29 and winding 6, epoxy 20 should then enter vertical channels 16 at approximately a temperature of 50°-60° C., and should flow along channels 16 until epoxy 20 encounters a horizontal channel 14. At that time, epoxy 20 should begin to flow along channel 14 until channel 14 is filled. Also, as seen in FIG. 2*b*, epoxy 20 should begin to flow around wire 62 and through glass cloth 60 so that superconductors 12 become impregnated with epoxy 20. Once channel 14 is filled, epoxy 20 should flow upward through vertical channels 16 until, again, another horizontal channel 14 is encountered. This filling technique is completed until a predetermined height, but not the entire height, of winding 6 is impregnated with epoxy.

After the predetermined length of impregnation of winding 6 is achieved, the epoxy 20 flow is stopped by manuevering valve 26 and vessel 4 is pressurized, preferably, with nitrogen, to a pressure of 600 mmHg by pressure sub-system 7. This pressurization should force epoxy 20 to substantially decrease the size of remaining gas bubbles entrapped within epoxy 20 on winding 6. It is to be understood that valve 26 is located in a position which is substantially level with the end cap 23 of winding 6. Valve 26 is positioned in this manner so that when the predetermined epoxy 20 level is reached, the epoxy 20 should not flow back into pipe 24 and thus, produce an inaccurate reflection of the amount of epoxy actually in vessel 4.

In order to assure that winding 6 is being filled evenly with epoxy 20, sensors 18 are located and embedded throughout channels 14,16. Sensor 18 is constructed, preferably, of a 5 micron thick, platinum plated tungsten wire 19. In particular, if it is noted that some sensors 18 in particular vertical channel 16, which are located above the sensors in a horizontal channel 14, are registering before all of the sensors in the lower horizontal channel 14 are registering, then, it is possible that the epoxy is not being distributed evenly and corrective measures must be taken. For example, valve 26 may need to be closed and vessel 4 may need to be pressurized, again, to an adequate level until all sensors 18 in that particular horizontal channel 14 are registering.

Figure 4:
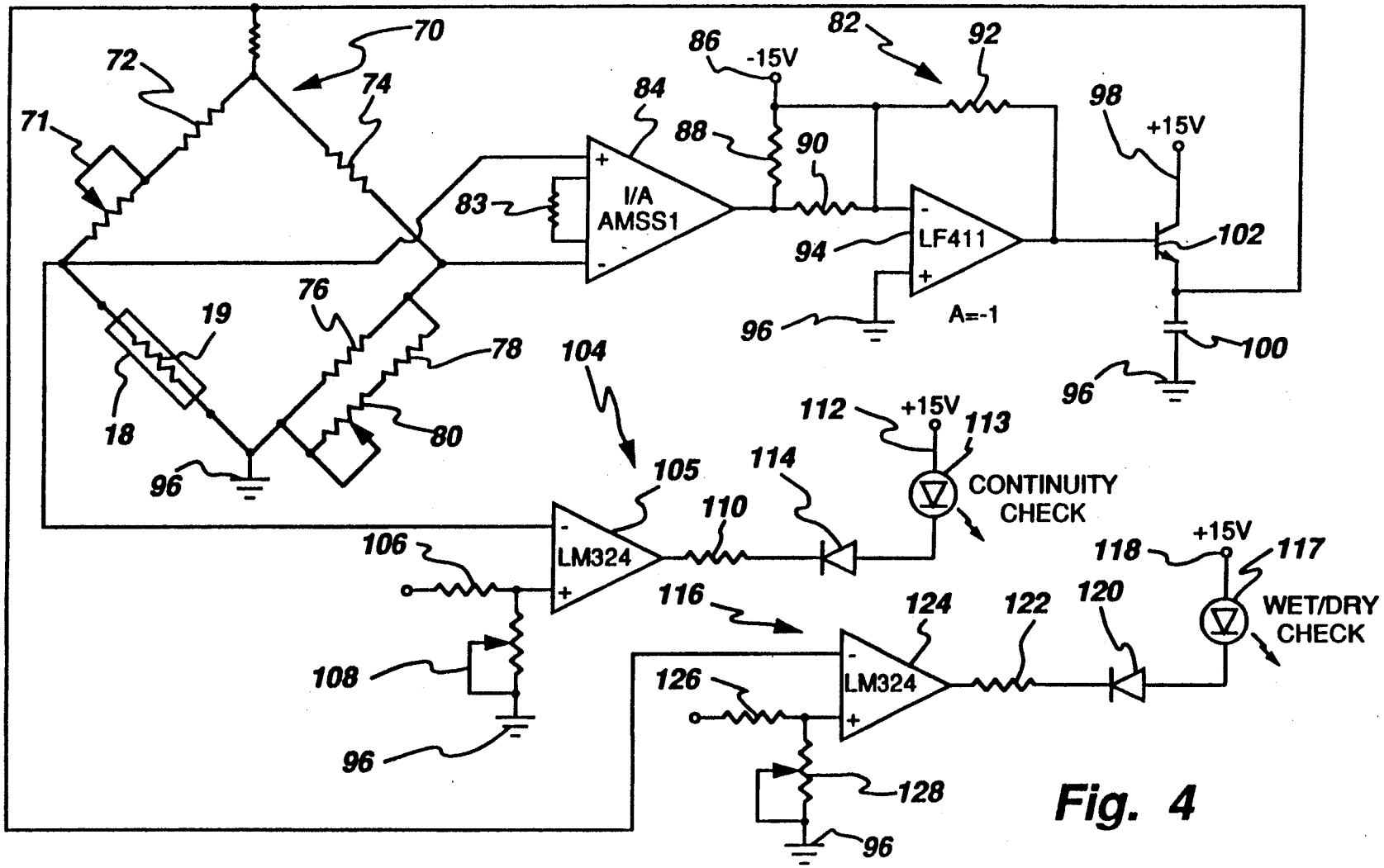
FIG. 4 is an electrical schematic drawing of the operation of the epoxy sensors.

As shown in FIGS. 4 and 5, sensors 18 are connected by conventional electrical connectors (not shown) to a conventional, internal feedback control panel 27. Each sensor 18 is connected as a leg of a bridge 70 which includes also a 10 ohm potentiometer 71, a 10 ohm resistor 72, a 20 ohm resistor 74, a 39 ohm resistor 76, a 50 ohm resistor 78, a 50 ohm potentiometer 80, and ground 96.

Each bridge 70 is connected to a conventional electrical circuit 82 which includes a resistor 83, an instrumentation amplifier 84, a −15 V power source 86, resistors 88,90,92, an operation amplifier 94, ground 96, a +15 V power source 98, a capacitor 100, and a Q1 transistor 102.

Both bridge 70 and electrical circuit 82 are electrically connected by conventional connectors (not shown) to continuity check 104 and wet/dry check 116. A plurality of continuity checks 104 and wet/dry checks are located on control unit 27.

Each continuity check 104 includes operational amplifier 105, resistor 106, potentiometer 108, resistor 110, a block reverse diode 114, a +15 V power source 112 and LED 113. Continuity check 104 should provide a signal which shows through the lighting of LED 113 if wire 19 in any particular sensor has been broken prior to being contacted by epoxy 20. In other words, if LED 113 is illuminated and it is reasonably be assumed that epoxy 20 has not reached that particular sensor 18, then that particular sensor 18 is probably defective. It is to be understood that while a particular sensor 18 may become defective before it is subjected to epoxy 20, there are several other sensors 18 which are located on the same horizontal and vertical planes as the defective sensor 18 so, the determination of the rate of epoxy filling and level of the epoxy should not be adversely affected.

Each wet/dry check 116 includes LED 117 a +15 V power source 118, a block reverse diode 120, a resistor 122, an operational amplifier 124, a resistor 126, a potentiometer 128, and ground 96. Elements 117,118,120,1122,124,126,128 and 96 are conventional. Wet/dry check 116 should provide an indication as to when a particular sensor 18 has been contacted by epoxy 20. If that sensor 18 has been contacted by epoxy 20, then the LED 117 in control panel 27 for that particular sensor 18 will be illuminated. It is to be understood that there are separate continuity checks 104 and wet/dry checks 116 for each sensor 18 and these checks 104,116 are located on panel 27. Also, wet/dry checks 116 show that if the epoxy level in system 2 has fallen, and epoxy 20 no longer contacts that particular sensor 18, then that LED 117 will go dark. The level of epoxy 20 may fall, for example, when being subjected to pressure during one of the pressurization steps, so that a fairly reliable determination can be made of the current epoxy level.

With respect to the operation of sensors 18, sensors 18 operate basically under the well-known principle that a wire when heated by variable current, the amount of current necessary to operate it will be altered, if that wire is subjected to a temperature change, for example, when contacted by a liquid having a lower temperature. It is important that sensor 18 should be capable of withstanding pressures between 1-2 and 600 mmHg, should register if contacted by epoxy 20 and should be capable of withstanding temperatures between 50°-100° C. while in contact and out of contact with epoxy 20.

Referring again to FIG. 1, overflow pipes 32 are connected by conventional connectors (not shown) to the end cap 21. Once epoxy 20 has reached the top of vertical channels 16, and it was determined that epoxy 20 has been evenly distributed through the registering at sensors 18, epoxy 20 begins to flow into pipes 32. The excess epoxy 20, then, is collected in overflow pan 34. The overflow pipes 32 and overflow pan 34 provide a back-up visual means of inspecting whether or not epoxy 20 has been evenly distributed throughout winding 6. In particular, if the operator, when looking through a conventional optical window 45, observes that epoxy 20 begins to flow out of all of pipes 32 and into pan 34 at approximately the same time, then, this indicates that epoxy 20 should have, at least, been evenly distributed at end cap 21 of winding 6.

After epoxy 20 is introduced into winding 6 and epoxy 20 is registered on sensors 18 and is visually observed to be overflowing into pan 34, the filling process is stopped. Winding 6 is then heated, by heaters 10, preferably, at 90° C. for 12 hours then heated at approximately 100° C. for 12 hours until the epoxy is cured.

Once epoxy 20 has cured, winding 6, sheet 29 and end caps 21,23 are removed from vessel 4. It is to be understood that manual removal of excess epoxy 20 should not be required once winding 6, sheet 29, winding 6 and end caps 21,23 are removed from vessel 4 after the impregnation process is completed because sheet 29, winding 6 and end caps 21,23 become an integral assembly which was bonded together by the cured epoxy.

Once given the above disclosure, many other features, modifications and improvements will become apparent to the skilled artisan. Such features, modifications and improvements are, therefore, considered to be a part of this invention, the scope of which is to be determined by the following claims.

What is claimed is:

1. An apparatus for impregnating superconductor windings with an epoxy compound, comprising:

a containment vessel;

a superconductor winding comprising a bobbin having inner and outer cylindrical surfaces with superconductor wires wound on said outer cylindrical surface and said winding being locatable substantially within said vessel wherein said bobbin further comprises;

a sensing means and channels located substantially on said outer cylindrical surface of said bobbin;

a pressure and vacuum means for said vessel;

a heating means for said vessel; and a means to introduce an epoxy compound into said vessel for impregnating said winding.

2. The apparatus for impregnating superconductor windings, according to claim 1, wherein said sensing means is located substantially on said bobbin for sensing said epoxy compound.

3. The apparatus for impregnating superconductor windings, according to claim 2, wherein said sensing means is located substantially in said channels.

4. The apparatus for impregnating superconductor windings, according to claim 1, wherein said sensing means comprises:

a signal means.

5. The apparatus for impregnating superconducting windings according to claim 4, wherein said signal means is substantially located adjacent to said winding and said heating means.

6. The apparatus for impregnating superconductor windings, according to claim 1, wherein said heating means is substantially located along said inner cylindrical surface of said bobbin.

7. The apparatus for impregnating superconductor windings, according to claim 1, wherein said winding is substantially located within an epoxy retaining cylinder means.

8. The apparatus for impregnating superconductor windings, according to claim 7, wherein said cylinder means is constructed of copper.

* * * * *